United States Patent [19]

Smith

[11] Patent Number: 4,830,231

[45] Date of Patent: May 16, 1989

[54] COMPOSITE DISK VALVE FOR DISPENSING CARTRIDGES

[75] Inventor: Ernest L. Smith, Kansas City, Mo.

[73] Assignee: Sealright Co., Inc., Kansas City, Mo.

[21] Appl. No.: 129,155

[22] Filed: Dec. 7, 1987

[51] Int. Cl.[4] ..... B65D 88/54

[52] U.S. Cl. ..... 222/327; 222/387; 222/490; 222/494; 222/213; 215/232

[58] Field of Search ..... 222/326, 327, 153, 386, 222/386.5, 542, 490, 491, 494, 213; 215/232; 229/5.5, 93; 137/849, 845; 156/69

[56] References Cited

U.S. PATENT DOCUMENTS

| | | | |
|---|---|---|---|
| 4,171,084 | 10/1979 | Smith | 215/232 |
| 4,432,473 | 2/1984 | MacEwen | 222/490 |
| 4,448,345 | 5/1984 | Helms | 215/232 |

*Primary Examiner*—Joseph J. Rolla

*Assistant Examiner*—Kenneth Noland

*Attorney, Agent, or Firm*—Kokjer, Kircher, Bradley, Wharton, Bowman & Johnson

[57] ABSTRACT

In a cartridge dispenser for dispensing mayonnaise-like food sauces in measured quantities, a laminated end disk which provides valving for the dispensed material. The end disk includes a paperboard layer for stiffness and rigidity, a polyethylene disk on the paperboard for shielding it from oils, a polyester disk beneath the paperboard for providing the valve, and an inner polyethylene disk allowing the composite disk to be secured on the end of the cartridge dispenser with a food grade adhesive. The polyester disk includes three equality spaced valves each formed by crosshair slits which provide vanes that open when material is being dispensed and quickly and cleanly close at the end of each dispensing stroke.

20 Claims, 1 Drawing Sheet

COMPOSITE DISK VALVE FOR DISPENSING CARTRIDGES

BACKGROUND OF THE INVENTION

This invention relates generally to the dispensing of materials such as food sauces and deals more particularly with an improved disk valve which controls the flow of materials that are dispensed from cartridge type dispensers.

In fast service restaurants and other retail food establishments, food sauces of various types must be dispensed in a large number of portions each containing a relatively small quantity of sauce. The sauces are usually a mayonnaise base salad dressing with various spices and other ingredients added to provide flavoring and/or texture. Because they have a consistency similar to mayonnaise, the food sauces are semi-solid and can be made to flow without great difficulty. Accordingly, it has proven to be convenient to package a wide variety of food sauces in cartridges from which the sauces are dispensed by hand held dispensing guns similar to caulking guns.

The dispensing gun includes a plunger which is advanced incrementally an identical distance each time its operating trigger is squeezed. The plunger in turn advances a plug in one end of the cartridge, and this causes a measured amount of sauce to be extruded out through a cross hair cut in the opposite end of the cartridge which serves as a dispensing valve. Reference may be made to U.S. Pat. No. 4,432,473 for a more thorough discussion of this type of dispensing cartridge and gun.

Although this manner of dispensing food sauces has been satisfactory for the most part, it has not been wholly free of problems. The end disk which serves as the dispensing valve is typically made from low density polyethylene which is slitted in a cross hair pattern to provide leaves or vanes which are normally closed but which open when internal pressure is generated by the advancing plunger. With polyethylene end disks, the size of the valve is based on the relationship between the viscosity of the product which is being dispensed and the "memory" of the polyethylene (i.e., its ability to return to its undeformed state following removal of the deforming force). If the valve is too large, the vanes do not exert sufficient back pressure to achieve an even and predictable product flow. As a consequence, the sauce oozes through the valve and is not cleanly cut off at the end of the dispensing operation, thus tending to "string" the food sauce as the dispensing gun in moved from one sandwich to another. Conversely, a valve that is too small results in excessive back pressure, and the sauce squirts out with so much force that it splatters and at times can displace lettuce and other condiments from the sandwich. Because only one valve is used, the product is dispensed over only a relatively small area and the dispensing operation suffers for this reason also.

SUMMARY OF THE INVENTION

From the foregoing, it is evident that a need exists for a cartridge dispenser end valve that operates to more closely control the dispensing of food sauces and to dispense them over a larger area than has been achieved in the past. The present invention is aimed principally at satisfying this need.

In accordance with the invention, a cartridge dispenser is provided with an end valve in the form of a composite disk made up of a number of different layers adhesively secured together. An outer polyethylene layer overlies a paperboard layer in order to shield the paper board from oils and other possibly damaging substances. The purpose of the paperboard is to provide the disk with sufficient stiffness and rigidity to permit it to be handled by existing "chip feeding" machines.

Underlying the paperboard is a thin layer of polyester which serves as the valve. Because of the good "memory" of polyester, the vanes of the valve are stiff enough to quickly close as soon as the dispensing pressure is relieved. Thus, the dispensing is closely controlled and there is neither "stringing" of the food sauce at the end of the dispensing operation nor forceful splattering resulting from excess back pressure. The polyester also permits three valves to be used in place of the single valve that has been provided in the past. Due to the presence of three equally spaced valve openings in the polyester disk, the sauce is spread over a relatively large area such that it is well distributed and can act as an adhesive to hold fine cuts of lettuce and other small condiments in place on the sandwich.

In order to hold the composite disk in place on the end of the dispensing cartridge, a second polyethylene disk may be adhesively secured to the inner side of the polyester disk. Polyethylene is compatible with available food grade adhesives, and the inner polyethylene disk provides a surface for adhesively securing the end disk in place on the cartridge. A suitable adhesive may be used to secure the polyethylene to the polyester.

DETAILED DESCRIPTION OF THE INVENTION

In the accompanying drawing which forms a part of the specification and is to be read in conjunction therewith and in which like reference numerals are used to indicate like parts in the various views.

Figure 1:
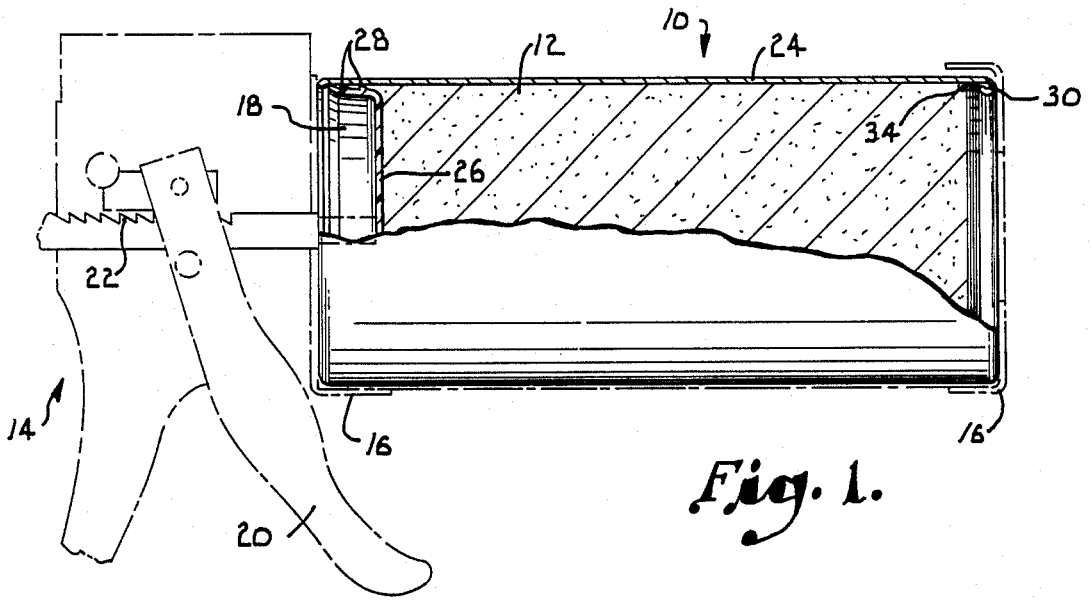
FIG. 1 is an elevational view of a cartridge dispenser having a composite end disk constructed according to a preferred embodiment of the present invention, with the cartridge shown partially in section and held by a dispensing gun.

Referring now to the drawing in more detail and initially to FIG. 1, numeral 10 generally designates a disposable cartridge type dispenser in which food sauce 12 is packaged and from which the food sauce may be dispensed by the operation of a hand held dispensing gun 14. The dispensing gun 14 is constructed to receive the dispenser 10 between a pair of flanged plates 16. The gun 14 includes a plunger 18 which fits in one end of the dispenser 10 and may be advanced into the dispenser by squeezing a trigger 20 which operates a ratchet mechanism 22. Each time the trigger 20 is squeezed, the ratchet mechanism 22 advances plunger 18 a preselected distance into the dispenser 10, and this results in the dispensing of a controlled amount of the food sauce 12. The dispensing gun is not a part of the present invention, and the manner in which it operates is more fully disclosed in U.S. Pat. No. 4,432,473.

Although the dispenser 10 may hold various types of flowable materials, it is contemplated that it will normally be used to dispense food sauces such as those used in high volume in fast service restaurants. Typically, the food sauces are mayonnaise based dressings and thus have a consistency and flowability similar to mayonnaise.

The cartridge dispenser 10 has a cylindrical body 24 which is preferably a foil laminated food grade paper board coated with thermal plastic. One end of the body 24 is provided with a plug 26 which closes the end of the cartridge and yet may be advanced within body 24 throughout its entire length by the plunger 18 of the dispensing gun 14. The side wall of the plug 26 may be provided with wiping ribs 28 which wipe the inside surface of body 24 as the plug is advanced.

The opposite end of the cartridge body 24 has an inwardly rolled rim 30. An end disk 32 constructed in accordance with the present invention is disposed against the inwardly rolled rim 30 and is secured to the inside surface of body 24 by a bead 34 of food grade adhesive which contacts the inside surface of the end disk 32. The outside surface of the end disk is exposed.

Figure 3:
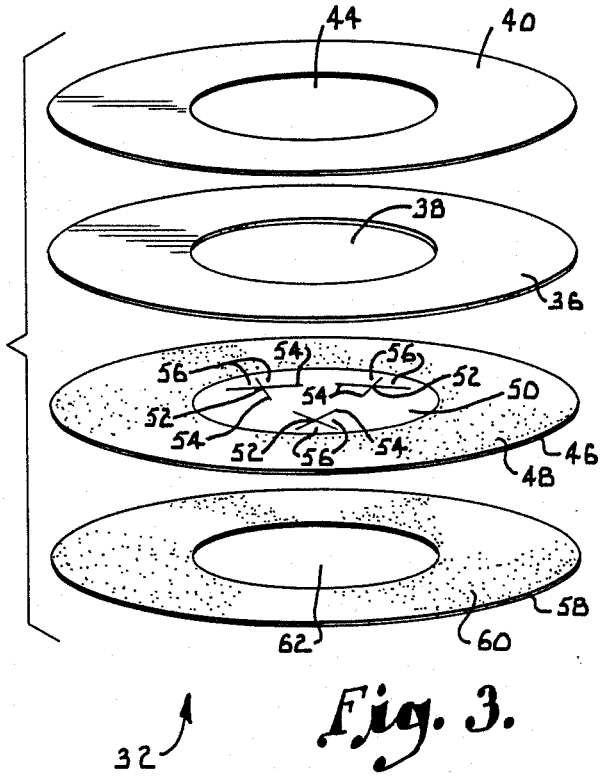
FIG. 3 is an exploded perspective view on an enlarged scale showing the various layers of the composite end disk.

FIG. 3 best illustrates the laminated construction of the end disk 32. Stiffness, thickness and rigidity are provided by a paperboard disk 36 which is thick enough to permit the disk to be handled and fed by existing "chip feeding" machines of the type currently used to apply polyethylene end disks to cartridges of this type. Disk 36 is preferably food grade paper board which may, but need not, be laminated with foil. A circular opening 38 is formed through the center of disk 36.

Figure 2:
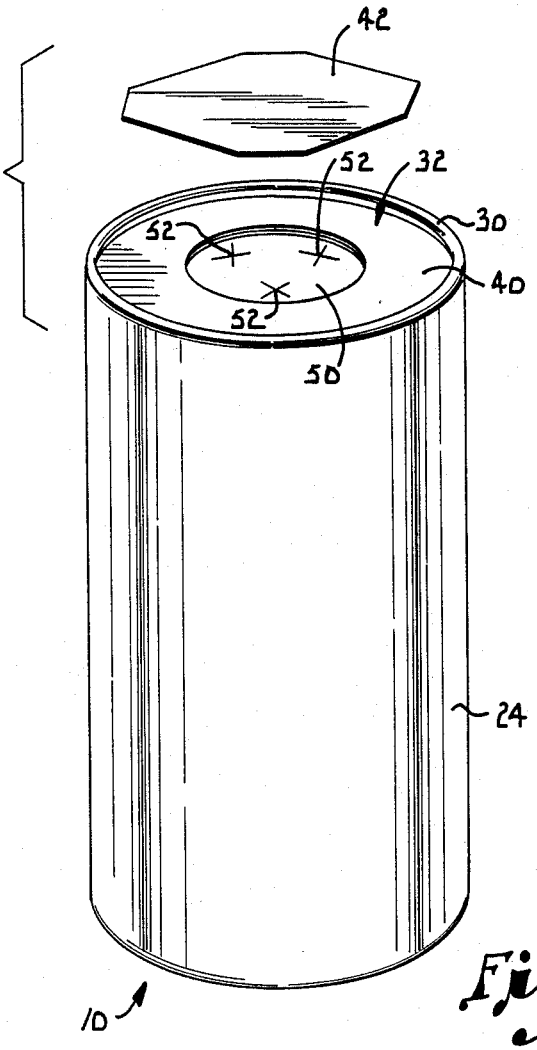
FIG. 2 is an exploded perspective view showing the cartridge of FIG. 1 and a seal strip which initially seals the valve of the end disk.

The outer surface of the paperboard disk 36 is covered by a polyethylene disk 40 which protects disk 36 and prevents it from being oil stained or subjected to other materials that could possibly damage the paperboard disk. The polyethylene disk 40 also provides an outer surface which is heat sealable in order to receive a foil sealing strip 42 (see FIG. 2) which will subsequently be described in more detail. Disk 40 has a circular opening 44 through its center. Heat sealing extrusion lamination, adhesive securement or any other suitable means may be used to secure disks 36 and 40 together. The two disks are equal in diameter, and the two openings 38 and 44 are equal in diameter and are disposed in registration with one another.

A polyester disk 46 provides the dispensing valve through which the sauce 12 is dispensed. A layer of suitable adhesive 48 is used to secure the polyester disk 46 to the underside of the paperboard disk. The adhesive 48 can either be a cold set glue or a heat seal coating, and it may be applied to disk 36 or 46 or to both. Disks 36 and 46 are equal in diameter.

The polyester disk 46 is provided with a circular valve area 50 in its center which is the same size as opening 38 and is in registration with the opening. The valve area 50 is provided with three spaced apart valve openings 52 which are each formed by a pair of intersecting slits 54 formed through the valve area 50 of the polyester disks. Each pair of slits 54 is made in a cross hair pattern, and the slits 54 in each pair intersect at their centers. Each pair of slits 54 thus form four leaves or vanes 56 which are located between the slits and which taper to in tip portions located adjacent to one another at the intersection between the slits.

The petals or vanes 56 are part of the polyester disk 46 and are normally coplanar with the remainder of the disk to close the valve openings 52. However, the vanes 56 may be displaced outwardly from the closed position when internal pressure is generated in dispenser 10 due to the advancing plug 26. When the vanes 56 are thus displaced outwardly, the valve openings 52 are opened to allow the sauce 12 to be dispensed through them. When the advancement of plug 26 is terminated at the end of each dispensing stroke, the "memory" or resiliency of the vanes 56 causes them to quickly return to their normal undeformed conditions, and the valve openings 52 are thus quickly closed immediately following the end of each dispensing stroke. The valve openings 52 are distributed uniformly in the valve area 50 and are spaced equally from one another and from the center of disk 46.

The stiff nature of polyester and the good "memory" it exhibits cause the vanes 56 to quickly close as soon as the positive pressure within cartridge 10 is reduced. The characteristics of the polyester also allow three valve openings 52 to be used within approximately the same area as has been occupied by a single valve in other known cartridge end disks. It has been found that good valve action results when the polyester disk 46 has a thickness between approximately 0.004 inch and about 0.006 inch. If the disk thickness varies appreciably from this range, the valve operation suffers.

A polyethylene disk 58 is secured to the underside of the polyester disk 46 by a suitable adhesive 60. Because polyethylene is not compatible with polyester, the polyethylene disk 58 cannot be extrusion laminated directly onto the polyester, thus the adhesive 60 is required to secure the two disks together. Disk 58 is the same diameter as disk 46 and is provided with a central opening 62 which has the same size as and is disposed in registration with the valve area 50.

The purpose for the polyethylene disk 58 is to provide a surface on the composite disk 32 for the adhesive bead 34. Currently available food grade adhesives are not compatible with polyester, and it is thus not feasible to adhesively secure the polyester 46 directly to the cartridge body 24. Preferably, the adhesive 34 is a suitable food grade hot melt luting which secures the periphery of disk 58 to the inside surface of body 24, thus securing the composite disk 32 in place against the rolled rim 30. It should be noted that disk 58 may not always be needed and may be eliminated if the polyester disk 46 can be secured directly to the dispenser 10.

The foil strip 42 is preferably provided with a heat seal or pressure sensitive coating on its underside. The strip 42 is larger than opening 44, and the heat seal or pressure sensitive coating adheres to the outer surface of disk 42 in order to cover the valve area 50 and the aligned openings 44 and 38. The coating on foil 42 is releasable from disk 40, and the foil strip can thus be removed when the cartridge dispenser 10 is to be used. When the foil strip is removed, the valve openings 52 are exposed so that the food sauce 12 may be dispensed through the valve openings 52.

The various layers of the composite end disks 32 are assembled and secured together, and the composite disk is applied to and adhesively secured to the end of dispenser 10. The foiled strip 42 is initially sealed to the outer surface of disk 40 to cover opening 44 and thus retain the contents within the dispenser 10.

When the sauce 12 is to be dispensed, cartridge 10 is placed in the dispensing gun 14, foil 42 is removed, and the trigger 20 is squeezed to dispense an incremental amount of the sauce. Each time the trigger is squeezed, plunger 18 is advanced an incremental distance and thus advances the end plug 26 the same distance to dispense a measured and consistent amount of the sauce 12. The sauce which is dispensed passes outwardly through the valve openings 52 since valves 56 are opened by the internal pressure caused by the advancing end plug.

At the end of the dispensing cycle, end plug 26 stops, and the internal pressure is reduced. As soon as this occurs, the vanes 56 immediately close due to the good "memory" characteristics of the polyester of which disk 46 is constructed. The valves thus quickly close at the end of the dispensing operation to prevent "stringing" of the food sauce as the dispensing gun is moved from one sandwich to another. At the same time, the vanes 56 smoothly open as the sauce 12 is dispensed, and they do not apply enough back pressure to cause the sauce to be squirted out of the cartridge with enough force to result in splattering. The overall result is that the sauce is dispensed in accurately controlled amounts, and the flow is cleanly and immediately cut off at the end of the dispensing stroke.

The presence of the three valve openings 52 allows the sauce to be dispensed over substantially the entirety provided of the valve area 50. The sauce is thus distributed over a larger area than occurs with disks having only a single valve, and this improved distribution of the sauce over a larger area allows the sauce to act as an adhesive which holds fine cuts of lettuce and other small materials in place on the sandwich.

The composite end disk 32 has a unique laminated construction in which each layer has the ability to effectvely perform its assigned function. Together, the layers cooperate to provide the end disk with improved operating characteristics which significantly enhance the valving action of the disk and more effectively distribute the food sauces and other materials which are dispensed from cartridge dispensers.

Although the disk is illustrated and described as being held in place on the cartridge by the adhesive bead 34, the disk can alternatively be provided with a peripheral skirt (not shown) which could be mechanically crimped onto the cartridge when the edge is curled to form the inwardly rolled rim 30. Suitable hot melt forming the bead 34 would then act as caulking to insure a leakproof seal between the disk and the cartridge. A combination of adhesive attachment and mechanical crimping can also be used to secure the disk.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A multiple layer end disk for a cartridge dispenser which dispenses food sauce, said end disk comprising:

a paperboard disk having an opening therein and inner and outer surfaces;

a thermoplastic disk substantially covering said outer surface of the paperboard disk, said thermoplastic disk having an opening therein registering with the opening in the paperboard disk;

a polyester disk on the inner surface of the paperboard disk, said polyester disk having a valve thereon in registration with the opening in the paperboard disk;

means for securing said paperboard disk to said thermoplastic and polyester disks to form a composite disk adapted for attachment to one end of the cartridge dispenser;

a valve opening in said valve area of the polyester disk; and a plurality of valves on said polyester disk normally covering said valve opening and being displaced from the valve opening to expose same for the dispensing of food sauce therethrough upon the exertion of internal pressure in the cartridge dispenser, said vanes being resilient to close the valve opening when the internal pressure is relieved.

2. The end disk of claim 1, wherein said vanes are located between a plurality of intersecting slits through the polyester disk in the valve area thereof, said slits providing the valve opening.

3. The end disk of claim 2, including a plurality of additional intersecting slits through the polyester disk in the valve area thereof but spaced from the first mentioned pair of slits to provide a second valve opening spaced from the first mentioned valve opening and a plurality of additional vanes between the additional slits which normally close the second valve opening but which may be displaced therefrom by internal pressure in cartridge dispenser.

4. The end disk of claim 3, including a seal strip releaseably secured to said thermoplastic disk at a location to cover the opening therein.

5. The end disk of claim 2, including a second thermoplastic disk secured to said polyester disk on a side thereof opposite the side to which the paperboard disk is secured, said second thermoplastic disk having an opening therein registering with said valve area and being compatible with food grade adhesive to permit adhesive attachment of the composite disk to said one end of the cartridge dispenser.

6. The end disk of claim 5, including a seal strip releaseably secured to the first mentioned thermoplastic disk at a location to cover the opening therein.

7. The end disk of claim 1, including:

second and third valve openings in said valve area of the polyester disk spaced from one another and from the first mentioned valve opening; and a plurality of additional vanes on said polyester disk normally covering the second and third valve openings and being displaced therefrom to expose the second and third valve openings in response to internal pressure in the cartridge dispenser.

8. The end disk of claim 7, wherein the vanes for each valve opening are located between a plurality of intersecting slits through the polyester disk in the valve area thereof, said slits providing said valve openings.

9. The end disk of claim 8, including a second thermoplastic disk secured to said polyester disk on a side thereof opposite the side to which the paperboard disk is secured, said second thermoplastic disk having an opening therein registering with said valve area and being compatible with food grade adhesive to permit adhesive attachment of the composite disk to said one end of the cartridge dispenser.

10. The end disk of claim 9, including a seal strip releasably secured to the first mentioned thermoplastic disk at a location to cover the opening therein.

11. The end disk of claim 7, including a seal strip releaseably secured to said thermoplastic disk at a location to cover the opening therein.

12. The end disk of claim 1, including a second thermoplastic disk secured to said polyester disk on a side thereof opposite the side to which the paperboard disk is secured, said second thermoplastic disk having an opening therein registering with said valve area and being compatible with food grade adhesive to permit adhesive attachment of the composite disk to said one end of the cartridge dispenser.

13. The end disk of claim 12, including a seal strip releaseably secured to the first mentioned thermoplastic disk at a location to cover the opening therein.

14. A multiple layer end disk for a cartridge dispenser which holds and dispenses flowable materials of mayonnaise-like consistency, said end disk comprising:

a paperboard disk having a central opening therein and presenting inner and outer surfaces;

a first polyethylene disk secured to and substantially covering the outer surface of said paperboard disk, said first polyethylene disk having a central opening therein registering with the opening in the paperboard disk;

a polyester disk adhesively secured to the inner surface of said paperboard disk, said polyester disk having an inner surface and presenting a valve area registering with the opening in the paperboard disk;

a second polyethylene disk adhesively secured to the inner surface of said polyester disk and having a central opening in registration with the opening in the paperboard disk, said first and second polyethylene disks sandwiching the paperboard and polyester disks therebetween to form a composite disk with said polyethylene disk providing a surface for adhesive securement to the cartridge dispenser to secure the composite disk on one end thereof;

a plurality of pairs of intersecting slits through said polyester disk at spaced apart locations on the valve area thereof, each pair of slits providing a valve opening and a plurality of polyester vanes on the polyester disk which normally close the valve opening but which are resiliently displaced therefrom by internal pressure in the cartridge dispenser during dispensing of the contents thereof; and a seal strip releaseably adhering to said first polyethylene disk to initially cover the opening therein.

15. The end disk of claim 14, wherein said pair of intersecting slits are three in number and are spaced substantially equidistantly from one another on said valve area.

16. In a dispenser of the type having a cartridge for holding food sauce and a plug on one end of the cartridge which may be advanced therein to dispense the food sauce from the other end of the cartridge, an improved end disk construction comprising:

a paperboard disk having a central opening therein and inner and outer surfaces;

a polyethylene disk secured to the outer surface of the paperboard disk and substantially covering same, said polyethylene disk having an opening disposed in registration with said opening with paperboard disk;

a polyester disk adhesively secured to the inner surface of the paperboard disk and presenting a valve area disposed in registration with the opening in the paperboard disk, said paperboard, polyethylene and polyester disks together providing a composite disk having a size to cover said other end of the cartridge;

means for securing said composite disk on said other end of the cartridge;

a plurality of spaced apart pairs of intersecting slits through said polyester disk in said valve area thereof, each pair of slits forming a valve opening and a plurality of blades on the polyester disk which normally close the valve opening but which are resiliently displaced from the valve opening by internal pressure within the cartridge effected when the plug is advanced therein toward said other end; and a seal strip releasably adhering to said polyethylene disk at a location to cover the opening therein.

17. The end disk construction of claim 16, wherein said securement means for the composite disk comprises:

a second polyethylene disk adhesively secured to the side of said polyester disk opposite the side thereof which is secured to the paperboard disk, said second polyethylene disk having an opening disposed in registration with said valve area; and a food grade adhesive securing said second polyethylene disk to said cartridge on said other end thereof.

18. The end disk of claim 17, wherein said pairs of intersecting slits are three in number and are spaced substantially equidistantly from one another on said valve area.

19. The end disk of claim 16, wherein said pairs of intersecting slits are three in number and are spaced substantially equidistantly from one another on said valve area.

20. The end disk of claim 16, wherein said polyester disk has a thickness in the approximate range of 0.004 inch to 0.006 inch.

* * * * *